US007896457B2

(12) United States Patent
Itoh

(10) Patent No.: US 7,896,457 B2
(45) Date of Patent: Mar. 1, 2011

(54) INK-JET RECORDING APPARATUS, INK-JET RECORDING METHOD, AND COMPUTER PROGRAM PRODUCT

(75) Inventor: Yutaka Itoh, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 945 days.

(21) Appl. No.: 11/601,666

(22) Filed: Nov. 20, 2006

(65) Prior Publication Data

US 2007/0132803 A1 Jun. 14, 2007

(30) Foreign Application Priority Data

Dec. 13, 2005 (JP) ..... 2005-359303

(51) Int. Cl.
*B41J 29/38* (2006.01)

(52) U.S. Cl. ..... 347/16; 347/14; 347/19; 347/104

(58) Field of Classification Search ..... 347/16
See application file for complete search history.

(56) References Cited

U.S. PATENT DOCUMENTS

| | | | | |
|---|---|---|---|---|
| 5,828,818 | A * | 10/1998 | Anzai | 358/1.18 |
| 6,385,406 | B1 * | 5/2002 | Funamizu et al. | 399/16 |
| 2003/0057635 | A1 | 3/2003 | Fukushima | |
| 2004/0041870 | A1 * | 3/2004 | Kohno et al. | 347/16 |

FOREIGN PATENT DOCUMENTS

| | | |
|---|---|---|
| CN | 1401499 | 3/2003 |
| JP | 08-090789 | 4/1996 |
| JP | 2003-094746 | 4/2003 |
| JP | 2004-059192 | 2/2004 |

OTHER PUBLICATIONS

Office Action dated Feb. 25, 2010 by Chinese Patent Office of counterpart Chinese application 2006-101656210, with English translation.

Office Action dated Nov. 13, 2009 by Chinese Patent Office of counter Chinese application 2006-101656210, with translation.

* cited by examiner

*Primary Examiner*—Matthew Luu
*Assistant Examiner*—Brian J Goldberg
(74) *Attorney, Agent, or Firm*—Harness, Dickey & Pierce, P.L.C.

(57) ABSTRACT

An ink-jet recording apparatus includes a sensor serving as a unit that detects a position of a trailing end of a recording sheet and a control unit serving as a unit that generates a layout of an image to be recorded. The control unit decides a position of the trailing end of the recording sheet based on a result of the sensor detection and layout information, calculates a recordable area, and performs control for not recording an image in areas other than the recordable area. A CPU in the control unit corrects the result of the sensor detection in deciding a position of the trailing end of the recording sheet.

3 Claims, 9 Drawing Sheets

| FIG. 8A |
| --- |
| FIG. 8B |

INK-JET RECORDING APPARATUS, INK-JET RECORDING METHOD, AND COMPUTER PROGRAM PRODUCT

CROSS-REFERENCE TO RELATED APPLICATIONS

The present document incorporates by reference the entire contents of Japanese priority document, 2005-359303 filed in Japan on Dec. 13, 2005.

BACKGROUND OF THE INVENTION

1. Field of the Invention

The present invention generally relates to ink-jet printing and specifically relates to deciding a position of a trailing end in a direction of conveyance of a recording sheet.

2. Description of the Related Art

In recent years, the technology for printers has made rapid progress according to the development of personal computers. The printers record images on sheets based on image information. Recording means for the printers that attracts attention most in recent years is an ink-jet recording system. An ink-jet recording system that record an image by ejecting an ink on a sheet from a recording head have become common. The advantages of the ink-jet recording system are that the ink-jet recording system can record a high-definition image at high speed and is more excellent than other recording methods in various points such as running cost and quietness.

Some ink-jet printers cause a charged belt, to attract a recording sheet and secure flatness of the recording sheet to write an image on the recording sheet. In this type of ink-jet printer, it is necessary to prevent an ink from adhering to the belt because of an error in size of the recording sheet. To solve this issue, this type of ink-jet printer includes a mechanism for detecting a position of a trailing end or an amount of margin of the recording sheet to prevent misrecording on the belt.

Specifically, in this type of ink-jet printer, a registration roller is provided on an upstream side in a conveying direction with respect to a carriage mounted with a print head and movable in a main scanning direction and a registration sensor is provided further on the upstream side than the registration roller. A position of a trailing end of a recording sheet is detected based on a detection signal of the registration sensor and an amount of conveyance of the recording sheet in a conveyance mechanism is calculated from a remaining printable distance or the like.

However, in a control system in the mechanism mounted on the printer of the ink-jet recording system, detection by a trailing-end detection sensor is monitored in polling by software and processing for absorbing chattering is required. Thus, a time lag occurs between an instance when this sensor is actually turned off and time when the software recognizes a result of the turn-off of the sensor. Therefore, it is likely that the recording sheet is conveyed until the turn-off of the sensor is decided and the position of the trailing end of the recording sheet deviates from a position where of the trailing-end detection sensor is turned off.

For example, Japanese Patent No. 3687634 discloses a printer that calculates a distance of sheet conveyance at low speed and a distance of sheet conveyance at high speed using two sensors and two measuring units, calculates a response delay time of the upstream side sensor from these two sheet conveying direction, and corrects a remaining printable distance on a sheet trailing end side using this response delay time.

Japanese Patent Application Laid-Open No. 2003-94746 discloses a recording apparatus that corrects, according to a characteristic of a detection delay of a detecting unit, a position of a recording medium corresponding to a recording position of a recording head stored by a conveyance history storing unit, evaluates an amount of margin of the recording medium based on positions of the recording medium before and after the correction, and controls a recording operation based on a result of the evaluation.

In the invention disclosed in Japanese Patent No. 3687634, the two sensors that detect a position of a trailing end of a recording sheet are used and a response delay time (a time lag) is calculated and corrected using measured values of conveyance speed and a conveyance distance. Thus, when performance of the sensors falls and an error occurs in a detection result, it is impossible to obtain an accurate position of the trailing end. Therefore, it may be necessary to use a correction value set in advance.

In the invention disclosed in Japanese Patent Application Laid-Open No. 2003-94746, a true detection time is calculated from a detection delay characteristic (a detection delay time) set in advance and a conveyance history (a sensor detection time). Correction for calculating a true detection position based on this true detection time is performed. It is preferable for more accurately obtaining a position of a trailing end of a recording sheet to use not only the calculation of a position of the trailing end of the recording sheet by a sensor but also other methods.

Thus, there is a need of a technology that can accurately detect a position of a trailing end and a recordable area of a recording sheet by using inexpensive configuration.

SUMMARY OF THE INVENTION

It is an object of the present invention to at least partially solve the problems in the conventional technology.

According to an aspect of the present invention, an ink-jet recording apparatus includes a conveying unit that conveys a recording medium; a detecting unit that detects a current position of a trailing end with respect to a conveying direction of the recording medium that is conveyed by the conveying unit; a correcting unit that corrects the current position to a corrected position; a generating unit that generates a layout of an image to be recorded; a calculating unit that calculates a recordable area in the recording medium based on the corrected position and the layout; and a control unit that controls an ink-jet printing unit so that the ink-jet printing unit prints the image inside the recordable area.

According to another aspect of the present invention, a method of ink-jet recording includes detecting a current position of a trailing end with respect to a conveying direction of a recording medium that is being conveyed in the conveying direction; correcting the current position to a corrected position; generating a layout of an image to be recorded; calculating a recordable area in the recording medium based on the corrected position and the layout; and controlling an ink-jet printing unit so that the ink-jet printing unit prints the image inside the recordable area.

According to still another aspect of the present invention, a computer program product comprising a computer usable medium having computer readable program codes embodied in the medium that when executed causes a computer to detecting a current position of a trailing end with respect to a conveying direction of a recording medium that is being conveyed in the conveying direction; correcting the current position to-a corrected position; generating a layout of an image to be recorded; calculating a recordable area in the recording medium based on the corrected position and the layout; and controlling an ink-jet printing unit so that the ink-jet printing unit prints the image inside the recordable area.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
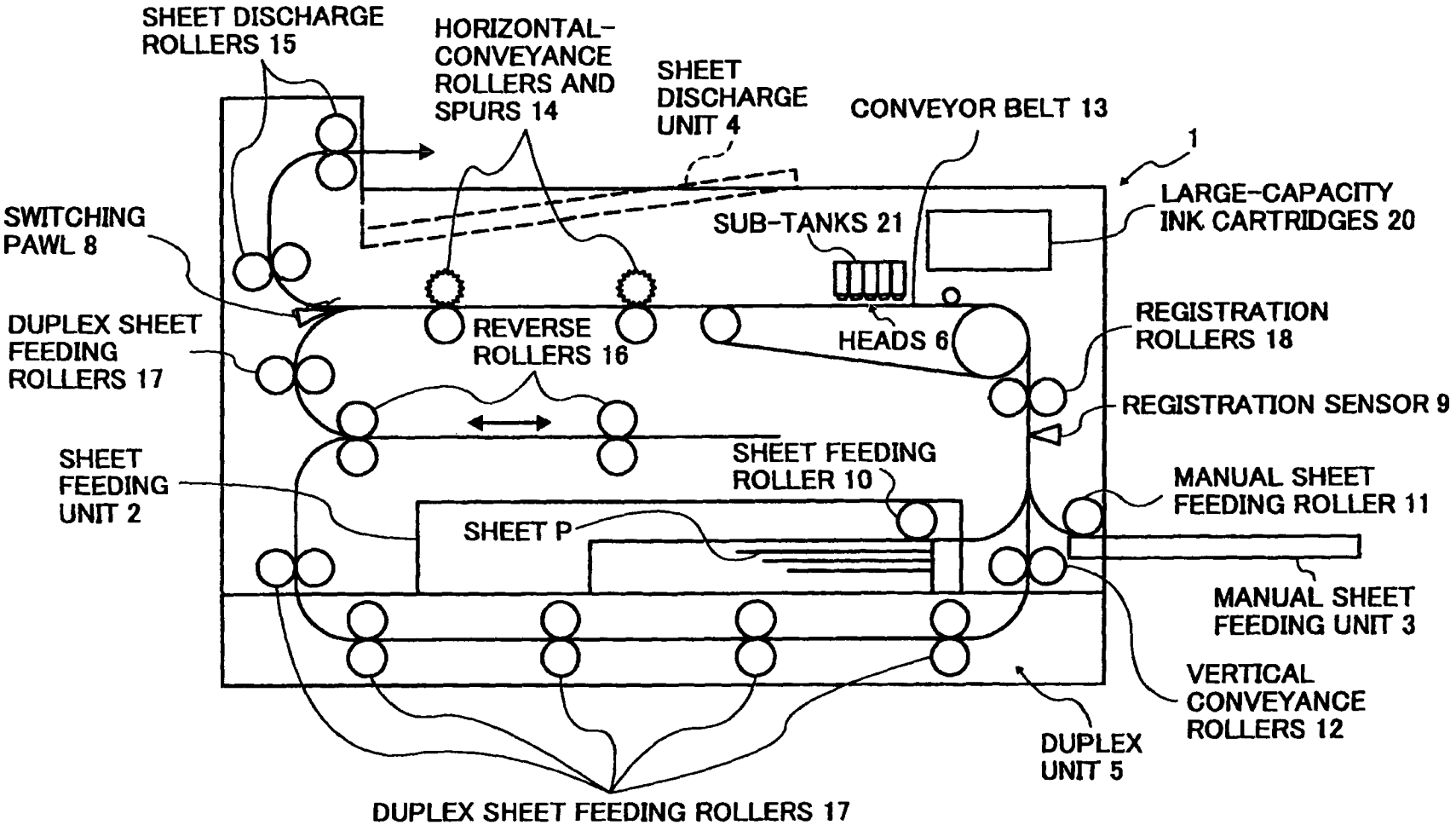
FIG. 1 is a schematic side view of an ink-jet printer according to an embodiment of the present invention.

First, an overall structure of an ink-jet printer 1, which is an ink-jet recording apparatus, according to an embodiment of the present invention is explained with reference to FIG. 1. In FIG. 1, a conveyance mechanism is mainly shown. The ink-jet printer 1 includes a sheet feeding unit 2, a manual sheet feeding unit 3, a sheet discharge unit 4, and a duplex unit 5. The manual sheet feeding Unit 3 store therein sheets of paper and when required feeds them.

The ink-jet printer 1 is connected to a network (not shown). When the ink-jet printer 1 receives a print request from an external personal computer (PC) (not shown) connected to the ink-jet printer 1 via the network, a sheet feeding roller 10 separates one sheet P from the sheets P stored in the sheet feeding unit 2 conveys the separated sheet P upward. The sheet P is temporarily stopped in a position of a registration sensor 9. Registration rollers 18 align a leading end of the sheet P. The registration rollers 18 start sheet feeding again at predetermined timing corresponding to output timing of image data.

After the sheet P reaches a conveyor belt 13, the conveyor belt 13 further conveys the sheet P. Heads 6 provided for respective colors of cyan, yellow, magenta, and black print images on the sheet P in a flat section on the conveyor belt 13. Horizontal conveyance rollers and spurs 14 convey the sheet P after the printing. After the elapse of time for drying inks, a switching pawl 8 switches paths of the sheet discharge unit and the duplex unit 5.

In the case of simplex printing, the switching pawl 8 is set on a solid line side to send the sheet P to sheet discharge rollers 15, reverse the sheet P, and discharge the sheet P to the sheet discharge unit 4. On the other hand, when duplex printing is performed, the switching pawl 8 is set on a dotted line side to send the sheet P to reverse rollers 16 side, reverse the sheet P, and send the sheet P through a path of duplex sheet feeding rollers 17 and vertical conveyance rollers 12 in the duplex unit 5. The registration rollers 18 feed the sheet P again. Images are formed on a rear side of the sheet P in a procedure same as the procedure for forming the images on the front side of the sheet P. After the images are formed on the rear side of the sheet P, the switching pawl 8 is set on the solid line side to send the sheet P to the sheet discharge rollers 15 side and discharge the sheet P to the sheet discharge unit 4.

Figure 2:
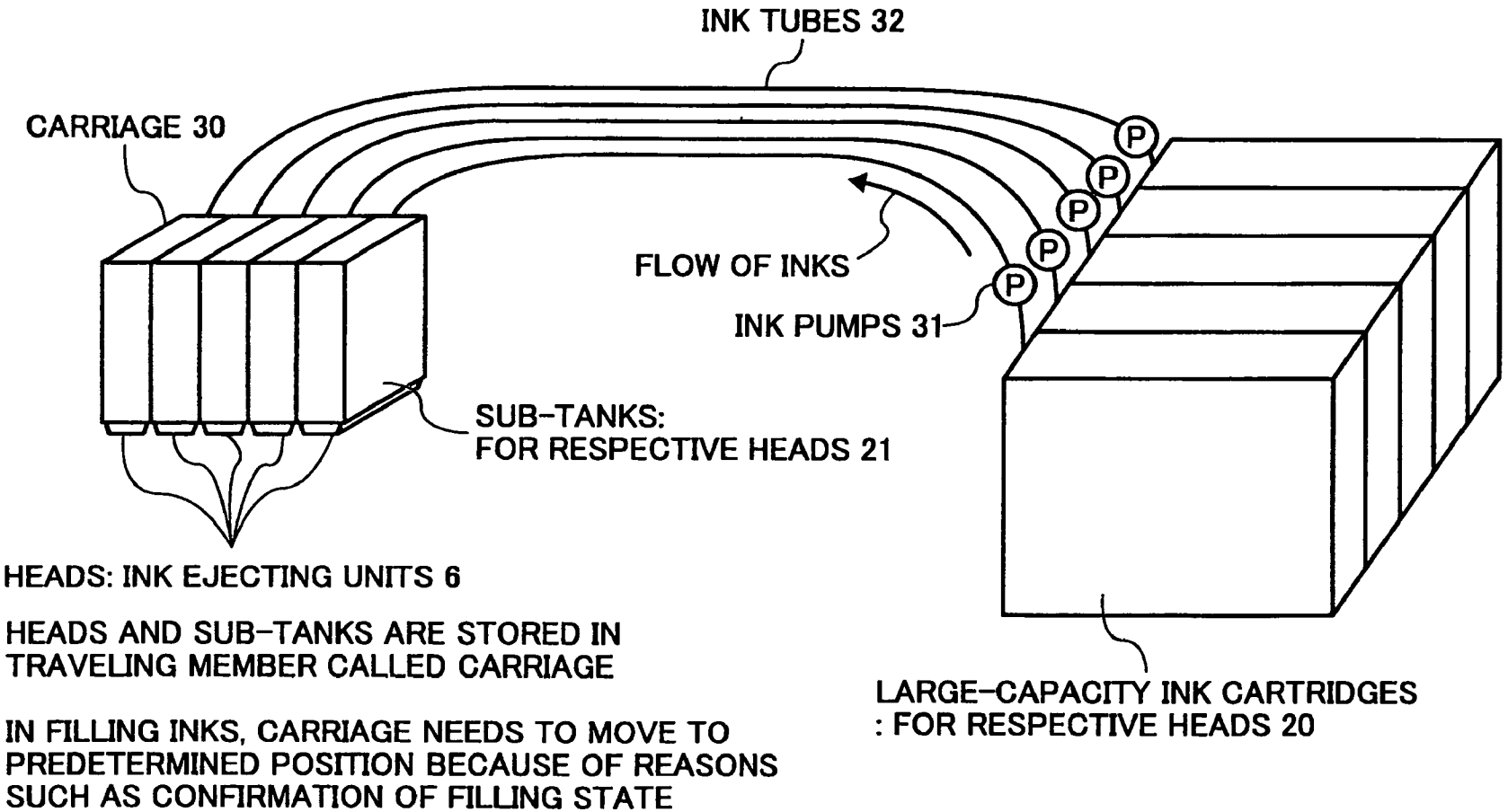
FIG. 2 is a schematic for explaining supply of ink from ink cartridges to ink heads in the ink-jet printer shown in FIG. 1.

FIG. 2 is a schematic for explaining supply of ink from large-capacity ink cartridges 20 to the heads 6 via sub-tanks.21. Operations for filling inks from the large-capacity ink cartridges 20 to the sub-tanks 21 are explained below with reference to the figure.

The large-capacity ink cartridges 20 are cartridges that are replaced by a user when the inks run out. It is possible to replace the large-capacity ink cartridges 20 for each of colors. Then inks are sent from the large-capacity ink cartridges 20 to the sub-tanks 21 by ink pumps 31 via ink tubes 32.

Not-shown sensors for detecting residual quantities of inks are provided in the large-capacity ink cartridges 20. Presence or absence of the inks in the large-capacity ink cartridges 20 is judged based on outputs of the sensors. When it is judged that there is no ink in the large-capacity ink cartridges 20, lack of inks is displayed on a not-shown display unit to urge the user to replace the large-capacity ink cartridges 20 with new ones.

When printing of a predetermined amount (density or the number of data) is performed, the inks run out in the sub-tanks 21. In that case, a carriage 30 is moved to a filling work position. This is because a not-shown sensor that checks quantities of inks in the sub-tanks 21 and a not-shown suction mechanism for solving clogging of the heads 6 are arranged in the filling work position. In other words, the carriage 30 is moved to the filling work position to perform cleaning of the heads 6 at the time when the inks are filled, idly eject the inks to prevent the heads 6, which correspond to colors not used for a predetermined period, from clogging, and perform a wiping operation for wiping the heads 6 with a not-shown mechanism. The operations described above are performed to fill the inks in the sub-tanks 21 from the large-capacity ink cartridge 20.

Figure 3:
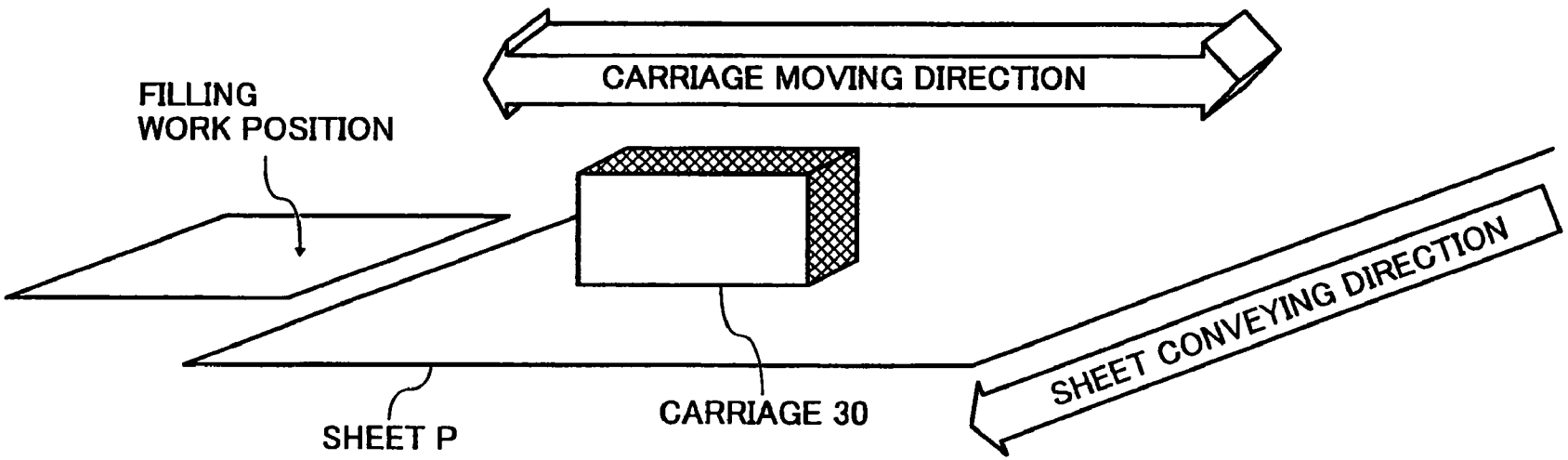
FIG. 3 is a schematic for explaining a printing operation performed by the ink-jet printer shown in FIG. 1.

FIG. 3 is a schematic for explaining an operation of the heads 6 in printing images on the sheet P. In performing image formation, the sheet P is conveyed and the carriage 30 integrated with the heads 6 and the sub-tanks 21 is moved in a direction perpendicular to the conveying direction of the sheet P. The heads 6 eject the inks on the sheet P based on print data for each of the colors to perform image formation.

Figure 4:
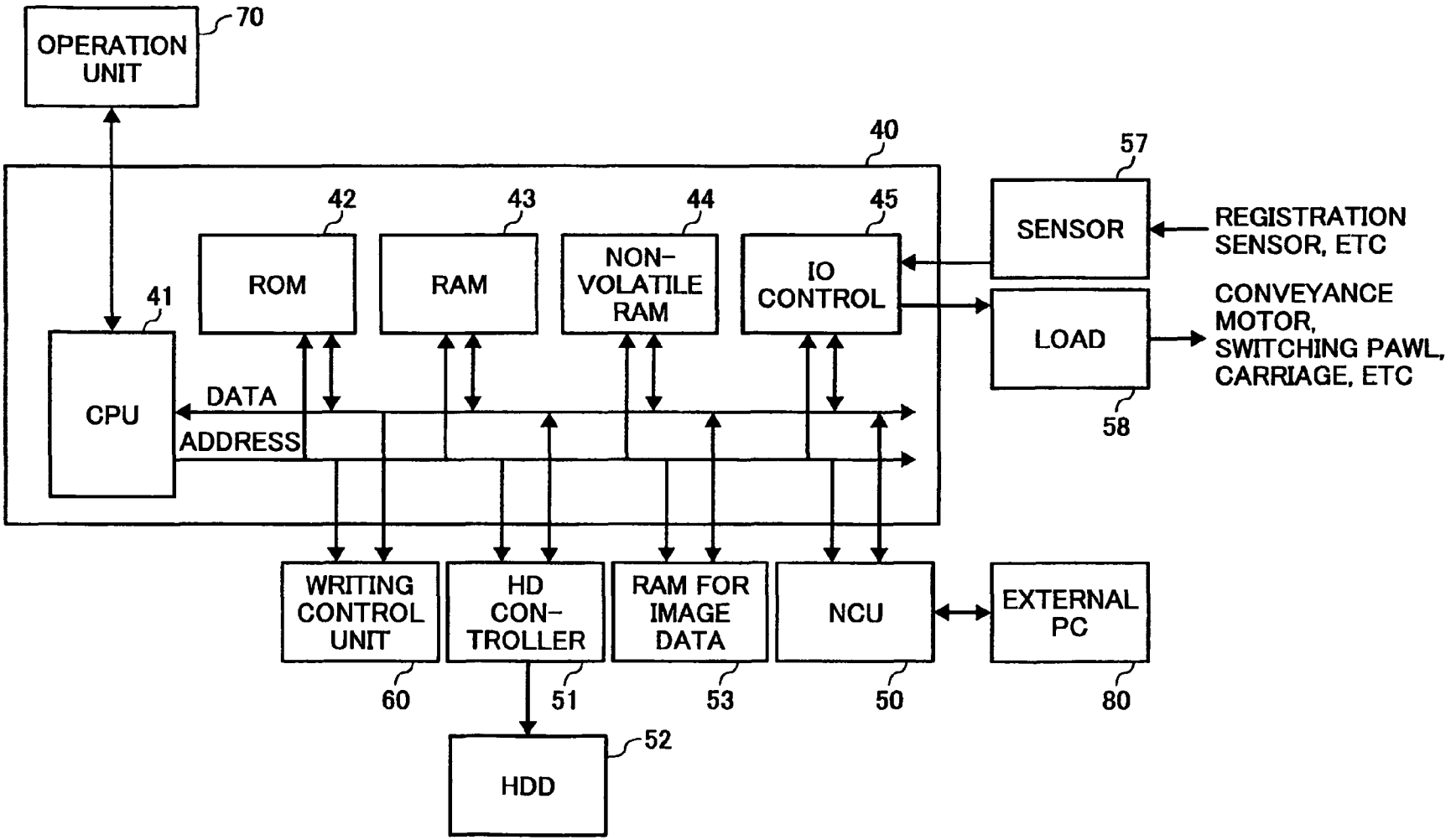
FIG. 4 is a block diagram of hardware configuration of the ink-jet printer shown in FIG. 1.

A structure of a control mechanism for the ink-jet printer 1 is explained below. FIG. 4 is a block diagram of hardware configuration of the ink-jet printer 1. Devices related to operation control and image data control are shown in the figure. All operations according to this embodiment explained with reference to flowcharts described later are realized by the control block.

A control unit 40 of the ink-jet printer 1 includes a central processing unit (CPU) 41, a read only memory (ROM) 42, a random access memory (RAM) 43, a nonvolatile RAM 44, and an input/output (IO) control 45.

The CPU 41 performs control for the ink-jet printer 1 according to a program stored in the ROM 42 and also performs operation control according to this embodiment described later. The ROM 42 stores a program for causing the CPU 41 to operate. The RAM 43 is a work area for programs. The nonvolatile RAM 44 stores adjustment values for control, timing, and the like and is capable of maintaining data even if a power supply is turned off. The IO control 45 performs control for a load 58 based on an input by a sensor 57.

The sensor 57 is one of various sensors such as the registration sensor 9. The load 58 is a not-shown conveyance motor or the like that drives the switching pawl 8, the carriage 30, the ink pumps 31, and respective conveying rollers.

The ink-jet printer 1 includes an operation unit 70. The operation unit 70 receives information such as an operation instruction and an apparatus state from the CPU 41 and sends operation setting content received from the user to the CPU 41.

The ink-jet printer 1 is connected to an external PC 80 and includes a network control unit (NCU) 50, a hard disk (HD) controller 51, a hard disk drive (HDD) 52, a RAM 53 for image data, and a writing control unit 60.

The NCU 50 receives printing data, control data, and the like from the external PC 80. The HD controller 51 controls the HDD 52. The HDD 52 stores printing data expanded by the CPU 41. The RAM 53 stores image data received from the external PC 80. The writing control unit 60 converts the image data inputted into an ink ejection operation of the heads 6 and prints an image on the sheet P fed.

A flow of control of image data is as described below. When image data is received from the external PC via the NCU 50, the control unit 40 temporarily stores the image data in the RAM 53, expands the image data as printing data using the CPU 41, and stores the image data in the HDD 52 via the HD controller 51 for controlling the HDD 52. The control unit 40 reads out the image data stored in the HDD 52 at predetermined timing corresponding to conveyance of the sheet P and inputs the image data to the writing control unit 60. The writing control unit 60 converts the image data inputted into an ink ejection operation of the heads 6 to print an image on the sheet P fed.

Operations for detecting a position of a trailing end of a recording sheet and deciding a remaining writable area in the ink-jet printer 1 are explained below.

Figure 5:
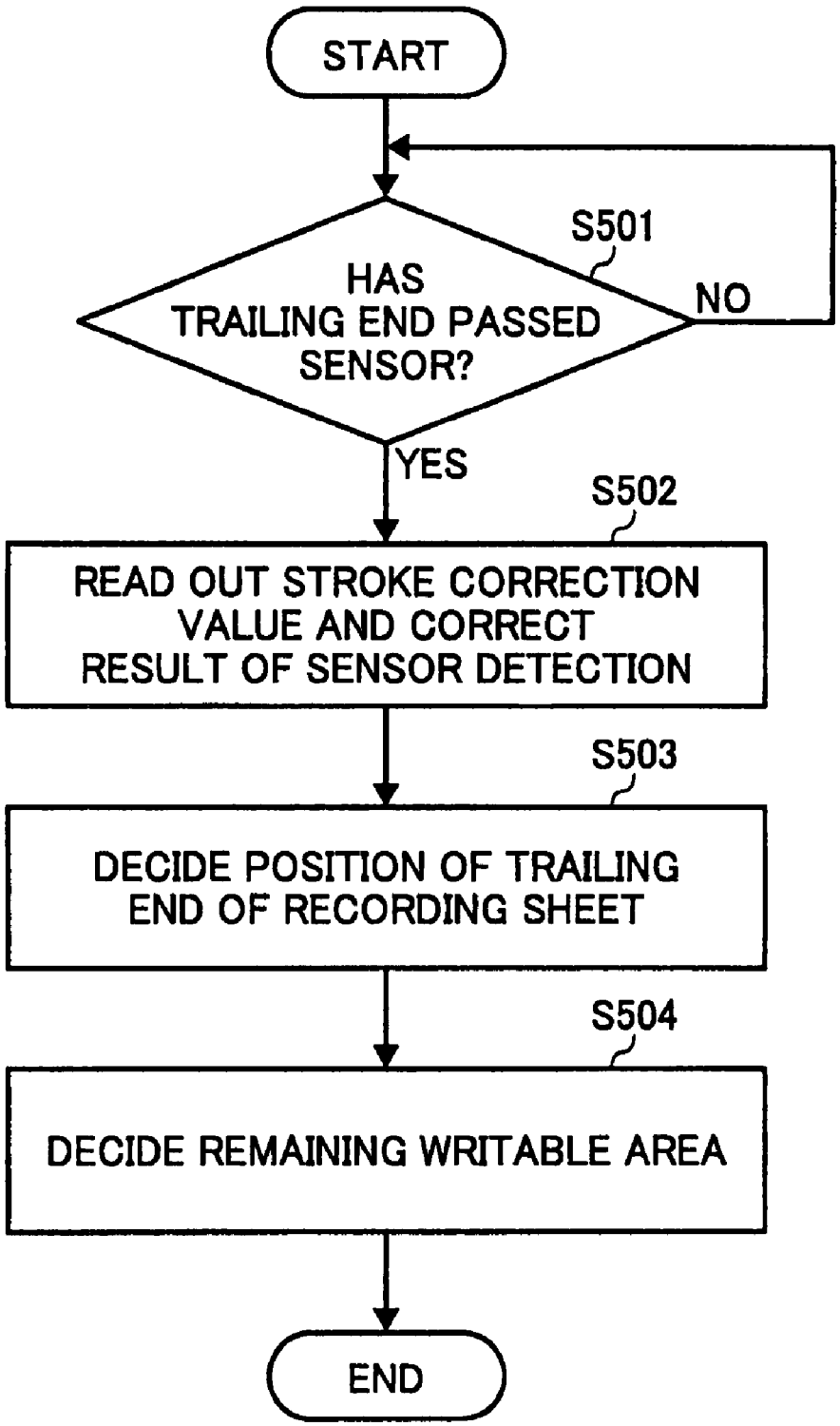
FIGS. 5 to 8 are flowcharts of operations performed by the ink-jet printer when deciding a writable area.

FIG. 5 is a flowchart of control of an operation for deciding a writable area in the ink-jet printer 1. In this flow, the control unit 40 decides, when a sensor detects that a trailing end of a recording sheet has passed the sensor, a remaining writable area from layout information and controls the ink-jet printer 1 not to write an image in areas other than the writable area. An inexpensive sensor of a filler system is used as the sensor. The sensor is located on an upstream side at a sufficient distance from a position of the heads 6.

First, the control unit 40 judges whether a trailing end of a recording sheet has passed the sensor (step S501). When the trailing end of the recording sheet has not passed the sensor (""NO"" at step S501), the control unit 40 returns to the judgment on whether the trailing end of the recording sheet has passed the sensor. When the trailing end of the recording sheet has passed the sensor (""YES"" at step S501), the control unit 40 reads out a stroke correction value and corrects a result of sensor detection (step S502).

Since the sensor is the inexpensive sensor of the filler system, a stroke of the filler affects the recording sheet until the trailing end of the recording sheet passes the sensor. The correction is performed to adjust the influence of the stroke. The control unit 40 stores a correction value in, for example, the nonvolatile RAM 44 in advance and performs the correction using the correction value. The correction value may be set and changed according to operation of the user. Moreover, it is also possible to change a nonvolatile RAM, in which a correction value is stored, according to a sheet type and absorb an influence of a stroke that varies depending on the sheet type.

After correcting the result of sensor detection, the control unit 40 decides a position of the trailing end of the recording sheet according to a result of the correction (step S503). The control unit 40 decides a remaining writable area based on the position of the trailing end decided and the layout information (step S504).

After deciding the remaining writable area, the control unit 40 cuts, in a page on which an image is currently printed, the image in areas other than the writable area.

Figure 6:
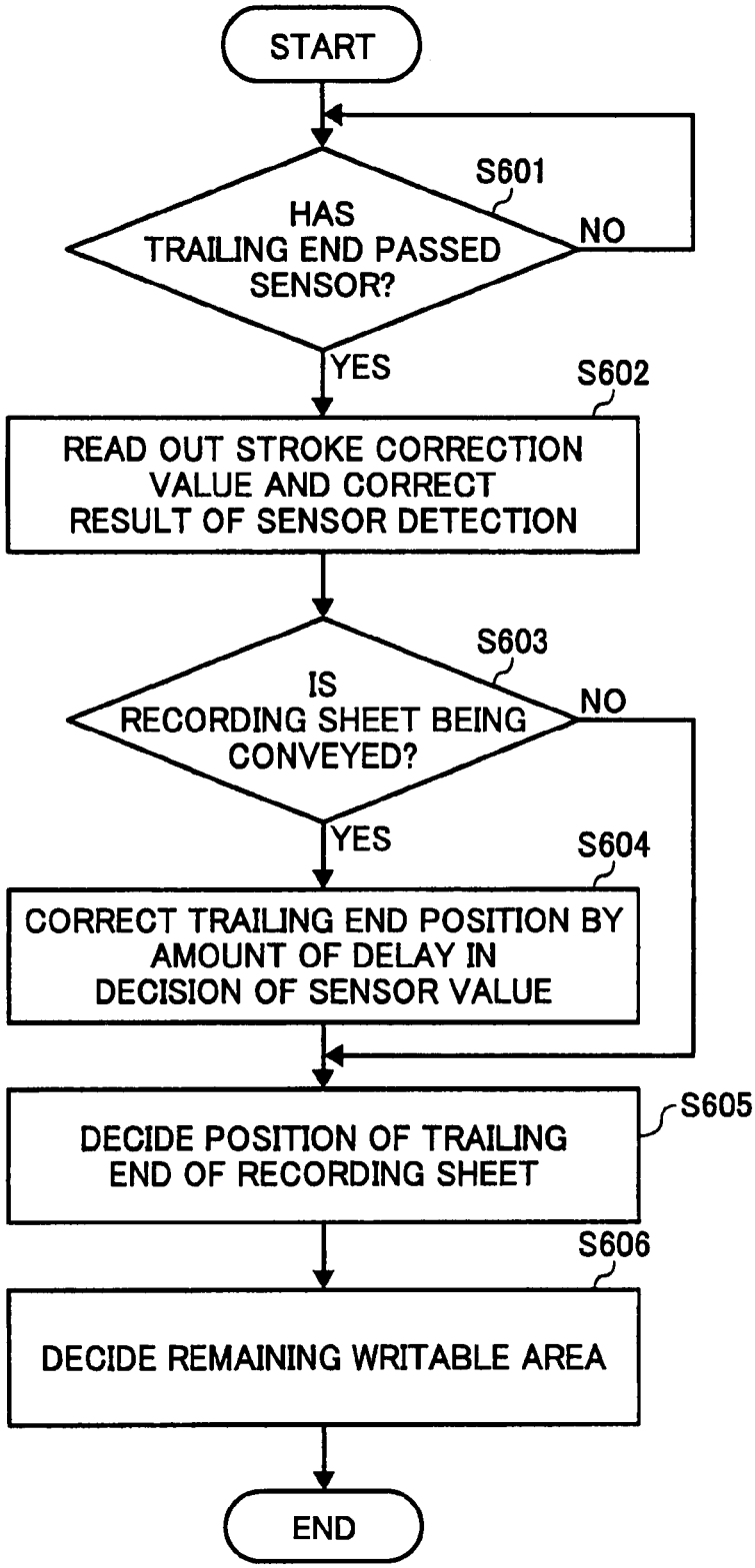

FIG. 6 is a flowchart of another control of the operation for deciding a writable area in the ink-jet printer 1. This flow is different from the flow in FIG. 5 in that a step for coping with deviation between a sensor detection position and a control unit recognition position due to the time lag described above is added.

In a printer of an ink-jet recording system that moves heads in a main scanning direction to write an image on a recording sheet, the recording sheet is divided into a plurality of belt-shaped areas in the main scanning direction to print page data on the recording sheet. Thus, conveyance of the recording sheet intermittent driving for repeating conveyance and stop in such a manner as "conveyance of the recording sheet by an amount of writing →writing→conveyance of the recording sheet by an amount of writing→writing . . . ". The control unit 40 monitors the sensor at an interval of, for example, a period of 2 microseconds and performs chattering absorption processing when a change occurs in the sensor. As a result, when the sensor is physically turned off, the control unit 40 recognizes the turn-off of the sensor, for example, 10 microseconds after the turn-off. When the recording sheet is conveyed at 200 mm/s, at a point when the control unit 40 recognizes the turn-off of the sensor, the recording sheet is 2 millimeters ahead of a position where the sensor is turned off. Thus, this error is innegligible. However, in the intermittent driving, since the recording sheet may be stopped simultaneously when the sensor is physically turned off, it is impossible to unconditionally correct the error of 2 millimeters. Therefore, it is necessary to cope with deviation of the position where the sensor is turned off at the time of the intermittent driving.

First, the control unit 40 judges whether a trailing end of a recording sheet has passed the sensor (step S601). When the trailing end of the recording sheet has passed the sensor (""YES"" at step S601), the control unit 40 reads out a stroke correction value and corrects a result of sensor detection (step S602).

The control unit 40 judges whether the recording sheet is being conveyed (step S603). When the recording sheet is being conveyed, the control unit 40 corrects a position of the trailing end of the recording sheet by an amount of a delay in decision of a sensor value (step S604). The amount of a delay in decision of a sensor value means an amount of movement of the recording sheet from the time when the sensor is actually turned off until the control unit 40 recognizes the turn-off of the sensor. On the other hand, when the recording sheet is not being conveyed but is stopped, the control unit 40 proceeds to the next step without performing the correction.

Information on whether the recording sheet is being conveyed or stopped is stored in, for example, the nonvolatile RAM 44 in the control unit 40. In the example described above, if the recording sheet is being conveyed when the sensor is turned off, the control unit 40 corrects the error of 2 millimeters and, if the recording sheet is stopped, the control unit 40 does not perform the correction. This makes it possible to absorb the error of the position of the trailing end due to the delay until the control unit 40 recognizes the turn-off of the sensor.

After correcting the amount of a delay in decision of a sensor value (step S604), the control unit 40 decides a position of the trailing end of the recording sheet (step S605) and decides a remaining writable area based on the position of the trailing end decided and the layout information (step S606).

Figure 7:
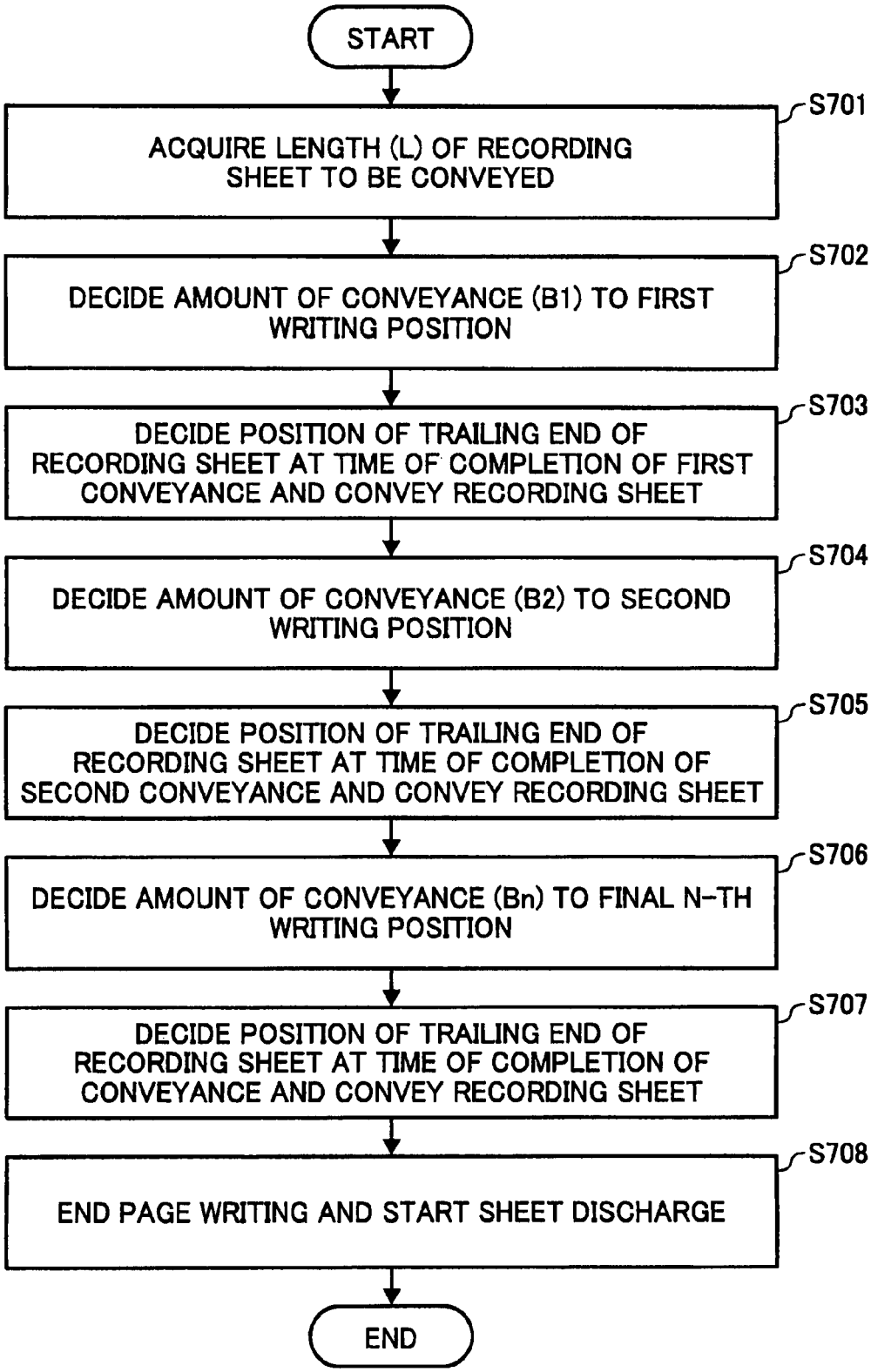

FIG. 7 is a flowchart of another control of the operation for deciding a writable area in the ink-jet printer 1. This flow is different from the flows in FIGS. 5 and 6 in that a position of a trailing end of a recording sheet is decided from an amount of conveyance of the recording sheet rather than a result of detection by the sensor or a result of correction of the detection result.

The flow in FIG. 6 is a flow for coping with deviation between a position where the sensor is turned off and a position where the control unit recognizes the turn-off of the sensor at the time of the intermittent driving. However, it may be impossible to sufficiently correct the deviation in the flow depending on linear speed of the intermittent driving and it may be impossible to accurately reflect the correction on the conveyance of the recording sheet during through-down. Thus, it is necessary to more accurately grasp a position of the trailing end of the recording sheet. Concerning a leading end position of the recording sheet, it is possible to decide a position without an error according to the control of the conventional registration adjustment. When the intermittent driving is performed, an accurate value of an amount of one conveyance is known. For example, when a recording sheet of a vertical A4 size is conveyed, the recording sheet is conveyed to a position 40 millimeters from a writing reference position in first conveyance. In other words, an amount of first conveyance is 40 millimeters. An amount of second conveyance is 30 millimeters and an amount of third conveyance is 35 millimeters. In this case, when the first conveyance is completed, a trailing end of the recording sheet is in a position 257 millimeters from the writing reference position. When the second conveyance is completed, the trailing end of the recording sheet is in a position 227 millimeters from the writing reference position. When the third conveyance is completed, the trailing end of the recording sheet is in a position 192 millimeters from the writing reference position. A remaining writable area is determined by deciding a position of the trailing end of the recording sheet according to this system.

First, the control unit 40 acquires length (L) of a recording sheet to be conveyed (step S701). The control unit 40 decides an amount of conveyance (B1) to a first writing position (step S702). The control unit 40 decides a position of the trailing end of the recording sheet at the time of completion of the first conveyance and continues to convey the recording sheet (step S703).

For example, the CPU 41 judges the length (L) of the recording sheet based on sheet feeding tray information and setting information of the user. For example, the CPU 41 accumulates amounts of conveyance (B1) of the intermittent driving and the nonvolatile RAM 44 stores accumulated data. The CPU 41 decides a position of the trailing end at the time of completion of the conveyance from a value obtained by deducting the amount of conveyance (B1) from the length of the recording sheet (L).

After step S703, the control unit 40 performs operations same as those applied to the first conveyance. The control unit 40 decides an amount of conveyance (B2) to a second writing position (step S704), decides a position of the trailing end at the time of completion of the second conveyance, and starts the following conveyance (step S705).

The control unit 40 decides an amount of conveyance (Bn) to a final n-th writing position (step S706), decides a position of the trailing end at the time of completion of the final conveyance (step S707), ends page writing, and starts sheet discharge (step S708). When the position of the trailing end of the recording sheet is decided, the control unit 40 decides a writable area based on a result of the decision.

Figures 8, 8A:
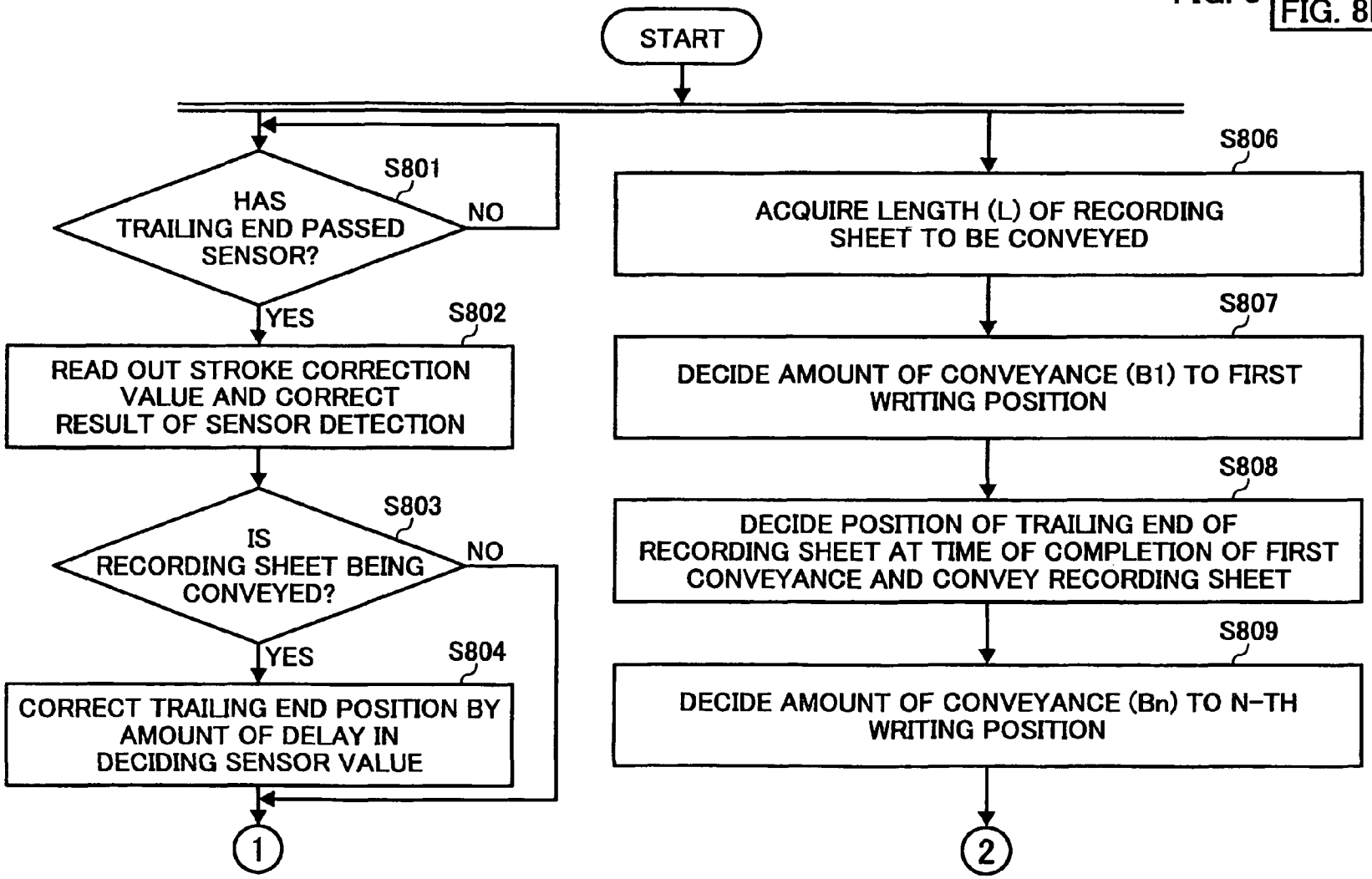
Figure 8B:
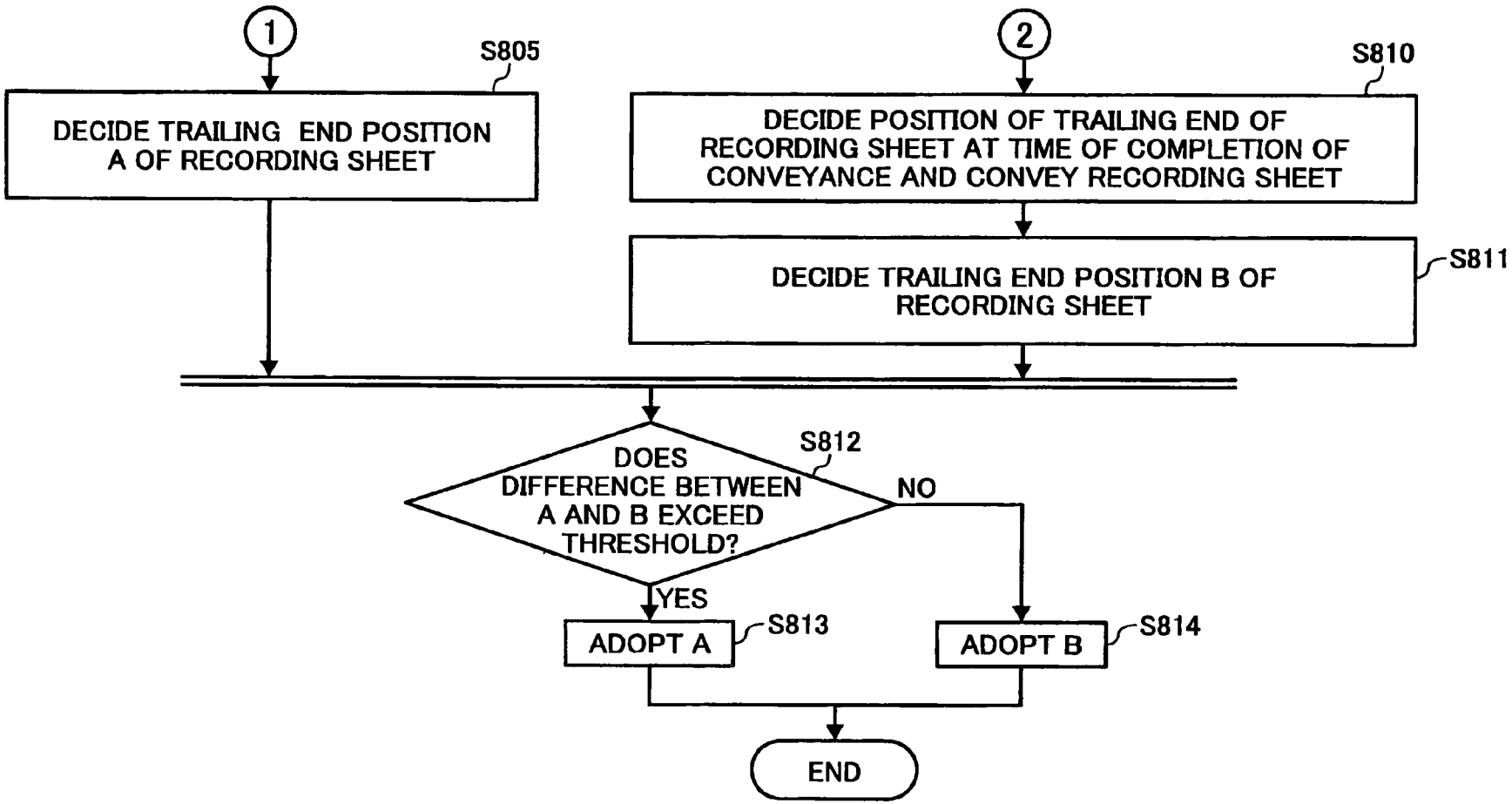

FIG. 8 is a flowchart of another control of the operation for deciding a writable area in the ink-jet printer 1. In this flow, the controls in FIGS. 6 and 7 are simultaneously performed and a result of one of the controls is adopted in a predetermined case to decide a position of a trailing end of a recording sheet.

The flow in FIG. 7 is valid on the premise that there is no error in sheet feeding tray information and user setting content. Thus, for example, when the user makes a mistake in setting vertical and horizontal sides of a recording sheet or when the user makes a mistake in setting a size of a recording sheet, a position of a trailing end of the recording sheet is different from an actual position. Therefore, it is possible to more surely decide a position of the trailing end of the recording sheet by not only calculating a position of the trailing end from an amount of conveyance as in the flow in FIG. 7 but also deciding a position of the trailing end using the trailing-end detection sensor as in the flow in FIG. 6.

Steps S801 to S805 are equivalent to the flow in FIG. 6. When the trailing end of the sheet has passed the sensor (""YES"" at step S801), the control unit 40 reads out a stroke correction value and corrects a result of sensor detection (step S802). When the recording sheet is being conveyed (""YES"" at step S803), the control unit 40 corrects the trailing end position by an amount of delay in deciding a sensor value (step S804) and decides a position of the trailing end of the recording sheet (step S805). The position of the trailing end of the recording sheet calculated by using the trailing-end detection sensor in this way is referred to as a trailing end position A.

On the other hand, steps S806 to S811 are equivalent to the flow in FIG. 7. The control unit 40 acquires a length (L) of a recording sheet to be conveyed (step S806). The control unit 40 decides an amount of conveyance (B1) to a first writing position (step S807) and decides a position of, the trailing end of the recording sheet at the time of completion of first conveyance (step S808). Thereafter, the control unit 40 repeats the same operations to decide a final n-th writing position (Bn) (step S809) and decides a position of the trailing end of the recording sheet at the time of completion of conveyance (step S810). The control unit 40 decides a final position of the trailing end of the recording sheet (step S811). The position of the trailing end of the recording sheet calculated by using an amount of conveyance in this way is referred to as a trailing end position B.

Steps S801 to S805 and steps S806 to S811 are simultaneously performed. The control unit 40 calculates the trailing end position A, which is a position at the time when the recording sheet is stopped, from a remaining amount of conveyance at a point when the trailing end of the recording sheet has passed the trailing-end detection sensor and the sensor is turned off while updating a position of the trailing end of the recording sheet calculated by using an amount of conveyance. On the other hand, the control unit 40 calculates and decides the trailing end position B in advance according to the system in which an amount of conveyance is used.

When the trailing end position A and the trailing end position B are decided, the control unit 40 judges whether a difference between the trailing end position A and the trailing end position B exceeds a threshold (step S812). When the difference exceeds the threshold ("YES" at step S812), the control unit 40 adopts the trailing end position A. When the difference does not exceed the threshold ("NO" at step S812), the control unit 40 adopts the trailing end position B. When the position of the trailing end of the recording sheet is decided, the control unit 40 decides a writable area based on a result of the decision.

The trailing end position A is a value obtained by measuring a position of the trailing end of the recording sheet with the trailing-end detection sensor, a so-called measured value. The trailing end position B is a value obtained by calculating a position of the trailing end of the recording sheet from an amount of conveyance, a so-called theoretical value. The threshold is a value set in advance to determine which of the measured value and the theoretical value should be adopted. The threshold is stored in, for example, the nonvolatile RAM 44. For example, if the threshold is determined as 3 millimeters, when a difference between the trailing end position A and the trailing end position B exceeds 3 millimeters, the control unit 40 judges that there is an error in sheet feeding tray information and user setting information and adopts the measured value, that is, the trailing end position A. When the difference does not exceed 3 millimeters, the control unit 40 judges that there is an error in the trailing-end detection sensor and adopts the theoretical value, that is, the trailing end position B.

The threshold may be a fixed value or may be a variable value that can be set and changed according to operation of the user. This is because it is conceivable that the error may be increased because of an increase in linear speed or the like of the intermittent driving. A nonvolatile RAM having stored therein the fixed or variable threshold may be provided for each of paper types.

The flow of deciding a position of the trailing end of the recording sheet using an amount of conveyance does not effectively function when the threshold is too large or when a difference of sizes between a letter size and an A4 size cannot be detected. Thus, means for switching valid and invalid for the flow of deciding a position of the trailing end of the recording sheet using an amount of conveyance may be provided. In this case, information on valid and invalid of the flow of deciding a position of the trailing end of the recording sheet using an amount of conveyance is stored in, for example, the, nonvolatile RAM 44. When the trailing end of the recording sheet has passed a predetermined sensor, the control unit 40 refers to the setting in the nonvolatile RAM 44. When the flow is valid, the control unit 40 performs the control of the flow. When the flow is invalid, the control unit 40 determines a position of the trailing end of the recording sheet only from information of the trailing-end detection sensor without performing the control of the flow.

The object of the present invention is also realized by supplying a program code of software for realizing the function concerning the control of the embodiment described above to the control mechanism in the ink-jet printer 1 and the control mechanism reading out and executing the program code.

The embodiment described above is merely a preferred embodiment of the present invention. The scope of the present invention is not limited only to the embodiment. It is possible to carry out the present invention in various modifications without departing from the spirit of the present invention.

According to the embodiment, it is possible to prevent adhesion of inks to the belt by detecting a trailing end of a recording sheet and cutting an image according to the trailing end of the recording sheet.

Moreover, it is possible to absorb individual differences such as fluctuation in the sensor and fluctuation in assembly by making an amount of an influence of a stroke of the filler variable.

Furthermore, it is possible to absorb an influence due to stiffness of a sheet by providing a setting value for each of sheet types.

Moreover, it is possible to decide a more accurate position of the trailing end of the recording sheet by correcting an amount of conveyance of a recording sheet from the time when the sensor is turned off until the software detects the turn-off and decides a position of the trailing end of the recording sheet.

Furthermore, it is possible to accurately determine a position of the trailing end of the recording sheet by deriving a position of the trailing end of the recording sheet from an amount of conveyance.

Moreover, it is possible to determine a more accurate position of the trailing end of the recording sheet by performing comparison of a measured value and a theoretical value is performed.

Furthermore, it is possible to provide a more flexible system by making the threshold.

Moreover, in deciding a position of the trailing end of the recording sheet using both the decision of a position of the trailing end by sensor detection and the calculation of a position of the trailing end by an amount of conveyance, it is possible to provide means for switching valid and invalid of the system for deciding a position of the trailing end of the recording sheet according to an amount of conveyance.

According to the present invention, an ink-jet printer that makes it possible to prevent adhesion of an ink to a sheet conveyor belt by highly accurately detecting a position of the trailing end and a recordable area of a recording sheet using an inexpensive sensor and control system and recording an image in the recordable area are realized.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A method of ink jet recording, the method comprising:

detecting a current position of a trailing end with respect to a conveying direction of a recording medium that is being conveyed in the conveying direction;

correcting the current position to a corrected position;

deciding whether, when the current position is detected at the detecting, the recording medium is being conveyed or the recording medium is standstill, wherein the correcting includes correcting the current position to the corrected position when it is decided at the deciding that the recording medium is being conveyed, and not correcting the current position to the corrected position when it is decided at the deciding that the recording medium is standstill;

generating a layout of an image to be recorded;

calculating a recordable area in the recording medium based on the corrected position and the layout;

controlling an ink-jet printing unit so that the ink jet printing unit prints the image inside the recordable area.

2. A method of ink jet recording, the method comprising:

detecting a current position of a trailing end with respect to a conveying direction of a recording medium that is being conveyed in the conveying direction;

correcting the current position to a corrected position;

generating a layout of an image to be recorded;

first calculating a recordable area in the recording medium based on the corrected position and the layout;

accumulating an amount of conveyance of the recording medium conveyed by the conveying unit in intermittent driving;

recognizing information of the recording medium;

second calculating including calculating a calculated position of the trailing end based on an accumulated amount of conveyance accumulated at the accumulating and information of the recording medium recognized at the recognizing;

deciding whether, when the current position is detected at the detecting, the recording medium is being conveyed or the recording medium is standstill, wherein the correcting includes correcting the current position to the corrected position when it is decided at the deciding that the recording medium is being conveyed;

calculating a difference between the calculated position and the corrected position;

selecting the corrected position when an absolute value of the difference is equal to or higher than a threshold, and selecting the calculated position when the absolute value is lower than the threshold, wherein the first calculating includes calculating the recordable area based on the value selected at the selecting and the layout; and controlling an ink jet printing unit so that the ink jet printing unit prints the image inside the recordable area.

3. The method according to claim 2, further comprising:

second deciding including deciding based on setting information whether the calculated position is to be calculated at the second calculating, wherein when it is decided at the second deciding that the calculated position is not to be calculated at the second calculating, the selecting includes selecting the corrected position.

* * * * *